United States Patent [19]

Nakagawa et al.

[11] 4,267,457

[45] May 12, 1981

[54] SAMPLE HOLDING ELEMENT FOR MASS SPECTROMETER

[75] Inventors: Yuzo Nakagawa, Suita; Kouji Iwatani, Amagasaki; Tetsuro Kadono, Neyagawa, all of Japan

[73] Assignee: Shionogi & Co., Ltd., Osaka, Japan

[21] Appl. No.: 950,697

[22] Filed: Oct. 12, 1978

[30] Foreign Application Priority Data

Oct. 20, 1977 [JP] Japan ..... 52-126455

[51] Int. Cl.[3] ..... H01J 29/02

[52] U.S. Cl. ..... 250/522; 250/288; 250/425

[58] Field of Search ..... 250/281, 282, 288, 289, 250/423 R, 424, 427, 522, 526; 313/348

[56] References Cited

U.S. PATENT DOCUMENTS

| | | | |
|---|---|---|---|
| 3,336,475 | 8/1967 | Kilpatrick | 250/425 |
| 3,852,595 | 12/1974 | Aberth | 250/288 |

*Primary Examiner*—Harold A. Dixon

*Attorney, Agent, or Firm*—Birch, Stewart et al

[57] ABSTRACT

Quantitative determinations by means of mass spectrometry of substances which have hitherto been very difficult to perform are made possible by the employment of the sample holding element of the present invention composed of a porous and gas-permeable aggregate of a skeletal ingredient having refractory and electrical-insulating properties, with a remarkable improvement in sensitivity and accuracy. Determination of mixture samples for their respective components is also effected without any preceding separating step.

21 Claims, 21 Drawing Figures

(Elements of Structure C) (Conventional Pot-Type Holder)

(Conventional) (Structure C)

I: , II: OCCH$_3$

SAMPLE HOLDING ELEMENT FOR MASS SPECTROMETER

BACKGROUND OF THE INVENTION

1. Field of the Invention

The present invention generally relates to the art of mass spectrometry. Particularly, it is concerned with a sample holding element for use in a mass spectrometer capable of introducing samples or solid specimens containing substances which had hitherto been considered to be very difficult to introduce into a vacuum chamber (ionization chamber) of a mass spectrometer. Such substances include those having excessively large or small volatility and those which are liable to sublimation. On the contrary, substances which are hard to sublime are also very difficult to be introduced. Furthermore the present invention relates to a sample holding element which enables the qualitative identification as well as quantitative determination of the respective compounds included in a mixture sample which is difficult to separate into the respective components at the preceding step.

2. Description of the Prior Art

Of various modes of sample introduction by means of conventional probes in the field of mass spectrometry, an indirect thermal introducing method wherein a reservoir for heated gas of large capacity is connected to an ion source, has hitherto been customarily employed. Disadvantages inherent to this method include a residual effect from the previously measured material which affects the sample to be determined thereafter and is quite frequent with ordinary organic compounds. Moreover a high probability of deteriorating or decomposing the compound during its long travel through an elongated pipeline kept at high temperature, has been confining the application of mass spectrometry to some limited species of substances over the years.

Under the stated circumstances, the so-called direct introduction method has recently been developed and has become prevalent. One conventional sample probe for use in this method includes a rod having a simple pot-like cavity for accomodating a sample or specimen at its tip. Should a liquid sample of especially high volatility have to be handled, an undesirable instant vaporization must inevitably be entailed, which must be suppressed or at least delayed by stuffing the cavity with a material such as asbestos despite the fact that such a material may be considered as being detrimental to the operators due to its suspected strong carcinogenicity.

Even when exercising a deliberate manipulation, the method of handling this probe, however, might lead to an inaccurate quantitative value of determination due to a possible insufficient ionization of the sample. The stuffing material may sometimes disperse so as to contaminate or pollute the environment around the equipment during the evacuating operation of the ion source after the specimen has been introduced. If the manual operation entails the contamination of the stuffing material, an increase in the noise level of the signal might be inevitable.

Recently, the scope of the sample which may be identified and determined by mass spectrometry has been extended to a great extent by the employment of the so-called "GC-MS" system which is a combination of a mass spectrometer with a separating means by gas chromatography. Even if the high cost of the GC-MS apparatus might be tolerated, this system has a serious disadvantage in that it is not suited for handling an unstable substance which may be extensively decomposed by heat applied thereto during the process of gas chromatography. In such cases, the sample might frequently require an additional operation of chemical modification to avoid such thermal decomposition prior to the gas chromatography by, for instance, silylation or acylation.

SUMMARY OF THE INVENTION

It is therefore a primary object of the present invention to provide a sample holding element for a mass spectrometer which is capable of introducing samples that are difficult to introducing directly into the ionization chamber of a mass spectrometer.

It is another object of the present invention to provide a sample holding element which enables any simple mass spectrometer to have a function similar to that of the GC-MS apparatus and to handle mixture samples without any preceding separating step.

It is a further object of the present invention to provide a method of mass spectrometry capable of quantitative determination of the substances which have hitherto been very difficult to handle in a conventional mass spectrometer.

It is still a further object of the present invention to provide a method of mass spectrometry capable of separating the mixture sample into its respective components in advance of the mass spectrometry.

Further objects and attendant advantages of the present invention will be disclosed in more detail in the following paragraphs.

According to the present invention there is provided a sample holding element for use in mass spectrometry which comprises a porous and gas-permeable aggregate of at least one skeletal ingredient of finely divided inorganic substance having refractory and electrical-insulating properties with a void ratio ranging from 15% to 70%, preferably from 25% to 60%.

The definitions as well as implications supplemental to the definitions of the terms referred to in this specification and appended claims, are as follows:

(1) Porous aggregate:

A porous and tenous body made to hold a given shape by compression or sintering. It may include a sintered body of fine particles or thin strings, a gas-permeable ceramic such as porous china and a compressed body of metal oxides.

(2) Skeletal ingredient:

Materials which constitute the framework of the aggregate to keep the given shape, including glasses (soda-lime glass, borosilicate glass, high silicate glass and lead glass), ceramic materials (metal oxides for pottery such as clay, kaolin and alumina, diatomaceous earth, silica, gypsum talc and potassium bromide), and of any shape including fine particles (distribution ranges from 1μ to 50μ) and thin strings (in particular in the case of glass).

(3) Finely divided substance:

This term should be interpreted to include any fine powdery or stringy and fibrous substance which may either be crystalline or amorphous.

(4) Void ratio:

The volumetric ratio of all spaces occupying the aggregate to the volume of the entire aggregate, calculated based on the intrinsic specific gravity of the skeletal ingredient and expressed as a percentage of the space for a given volume of the aggregate.

(5) Sintering:

Heating of the skeletal ingredient at a temperature for a time period sufficient for bonding the surface of the particles or thin strings to each other (a temperature somewhat lower than this can initiate the melting of the body of the ingredient, for instance, approximately 650°–750° C. for ordinary soda-lime glass for approximately 3–20 minutes, depending on the material and dimension (particle size or section diameter of the strings)).

(6) Compressed body:

An aggregate body formed by compacting or stamping the skeletal ingredient by the use of any compressing means which may be represented by a tabletting machine. Pressures up to 200 kg/cm$^2$ are usually sufficient for compacting and the combination of the skeletal ingredient is kept by van der Waals forces. Any auxiliary binding agent such as gypsum or talc may optionally be incorporated therein.

(7) Interstices:

Voids or spaces formed within the porous aggregate. At least part of them are connected to each other and have an internal diameter of from 10 m$\mu$ to 100$\mu$. The dimension of the interstices (pore size) may be adjusted by deliberately selecting the size of the skeletal ingredient and conditions of the aggregating operation as well as the species of the auxiliary material (for instance, adsorbent).

(8) Silylation:

An alkylsilylating operation (for instance, methylsilylation) of the silanol group exposed over the surface of the material of the skeletal ingredient, particularly, of glass in order to form a consistent water-repelling or inert film over the surface. Generally, dimethyldichlorosilane, methyltrichlorosilane or a mixture thereof, may be used for the alkylsilylation of glass surfaces. The silylated aggregate is particularly suited for the measurement of compounds of high polarity, for instance, saccharides, oligopeptides and alkaloids.

(9) Chromatographically-active adsorbent:

Throughout this specification and claims, this term is mainly referred to, to designate an adsorbent for thin layer chromatography, and may be exemplified as silica gel, alumina, diatomaceous earth, zeolite, magnesium silicate and porous glass powder (may be obtained by treating high silicate glass with an acid and removing any acid-soluble component therefrom to form innumerable pores, and is represented by one having a trade name Porous Vycor available from Corning Glass Works, U.S.A.). If the adsorbent has a dehydrogenating catalytic activity, it is preferable to avoid the use of an absorbent for a sample including compounds sensitive to being subjected to a dehydrogenating reaction. The adsorbent may have an average size distribution which is approximately comparable to that of the skeletal ingredient and may be embraced within the interstices and between or among the particles of the skeletal ingredient. In this sense, the term "embraced" should be interpreted to include a situation wherein the particles of the adsorbent are intimately adhered to the surfaces of the skeletal ingredient and may be embedded therein, without being substantially reduced in its effective surface aerea or being adversely affected of in its chromatographic activity (performance as an adsorbent) but maintaining a surface effective as an adsorbent. The adsorbent may be incorporated into the mixture in a ratio with respect to the skeletal ingredient from 1/30 to approximately the same quantity by weight. In addition to these, a filling material for a column used in gas-chromatography may be exemplified as other materials having chromatographic activity.

(10) Fluorescent material:

Any crystalline activation-type fluorescent material capable of emitting visible light upon excitation by ultraviolet rays, may be used in order to identify and locate substances which have no absorption band within the visible ray region and are inherently colorless but have any absorption band within the ultraviolet region, in advance of the actual mass spectrometry. From approximately one tenth (1/10) to one thirtieth (1/30) of the fluorescent material by weight of the skeletal ingredient may be incorporated. It may either be a pre-mixed type incorporated in the adsorbent (for instance, Merck: Silica Gel GF) or be a separate material which is embraced within the interstices in the same manner and together with said adsorbent particles. In a particular case wherein the material of the skeletal ingredient itself is capable of emitting light, that is, capable of functioning as the fluorescent material, a similar performance of the aggregate can be expected even with the omission of the incorporation of the fluorescent material. Such material may be exemplified as ionic luminescent glasses of uranium glass (containing about 2% wt, of $U_3O_8$) of green luminescence or lead glass (containing about 23% wt, of PbO) of blue luminescence.

(11) Solid supporting rod):

A rod having a shape approximately similar to that used with the conventional probe for a mass spectrometer but carrying the porous aggregate adhered to be fixed at its tip portion as illustrated in FIGS. 1A and 1A'. Usually, a quartz rod of high refractory property is employed. The rod may be made of any kind of glasses, however, if the refractory property is not particularly required. If the material is the same as that of the skeletal ingredient, welding is preferable for the adhering operation but a rod may be made of a material different from that of the skeletal ingredient. In the latter case, the connection may be made with a specific adhering agent (for example, SUMICERAM, available from Sumitomo Chemical Co., Ltd.,).

(12) Solid supporting rod:

A supporting rod, wherein most of the outer surface thereof is covered with a layer of the aggregate as illustrated in FIG. 1B and is almost similar to those being conventionally used in the Flame Ionization Detector (FID). Details of the preparation of such rods and of the application to other fields are at least partly disclosed in the specification of U.S. Pat. No. 3,839,205, British Pat. No. 1,390,258 or French Pat. No. 2,152,142. Various glass materials other than quartz may, however, be used for the rod applicable to this field because the high degree of refractory property essential for the devices used in FID is not required in most cases. The sample holding element of this type has another advantage that it may be used in a conventional ascending development to form a chromatogram which gives an operator preliminary identification of the intended substances included in the mixture sample and separated into its components. The particular portions of the aggregate carrying the respective substances may be cut into fragments each of which is separately introduced into the ionization chamber of the mass spectrometer for quantitative evaluation.

(13) Solid tubular support:

A through tube capable of accomodating at least one of said aggregate at the tip portion thereof by welding or adhesion; the opposite root portion having an open end and being engageable with the bracket of a direct sample introducing probe of a mass spectrometer. It may be made of any refractory material having an electrical insulating property such as quartz or borosilicate glass. If the skeletal ingredient is glass, the identical material is preferred in view of the convenience in the welding operation.

(14) Sealable:

The open end of the root portion of the tubular support must be sealed air-tightly after being injected with a sample. If the holder is disposable, the open end may be fused to seal itself. The open end may also be sealed by an elastic plug made of a chemically-stable and heat-resistant material such as Teflon or silicone rubber.

(15) Additional aggregate:

Preferably, a compressed or sintered body formed of a chromatographically-active adsorbent as its principal component which is different from said porous aggregate arranged at the tip of the tubular support in its ingredient. A deliberate operation is required to form such an aggregate so that its external diameter may conform to the internal diameter of the tubular support to make the aggregate contact with the inner surface of the tubular support as intimately as possible. A plurality of aggregate may be pushed into the supporting tube for stacking in the tube if the length of the single piece is not sufficient for the expected separating performance.

(16) Additional aggregate:

A different or the same ingredient and size may be applied as used in constituting the tip aggregate. The dimensions of the interstices (pore size) and location of the additional aggregate relative to the tip aggregate, and the amount of the additional aggregate, may be selected to optimize for the sample to be determined and conditions employed in mass spectrometry.

(17) Section diameter:

The root portion of the supporting rod or tube must be made to conform in dimension to engage with the bracket of the sample introduction probe of the mass spectrometer (approximately 3 mm). If the element is applied to the so-called In-Beam system, wherein the sample is directly exposed to the intense electron beam, the tip portion of the element should be capable of penetrating into a sample gas introducing aperture (approximately 1.5 mm, in diameter) of the ionization chamber. Therefore the diameter of the tip portion must be made smaller than that of the root portion. It however is not essential if the construction of the ion source is modified to that used in the Field Disorption (FD) system.

DESCRIPTION OF THE PREFERRED EMBODIMENTS

Figure 1:
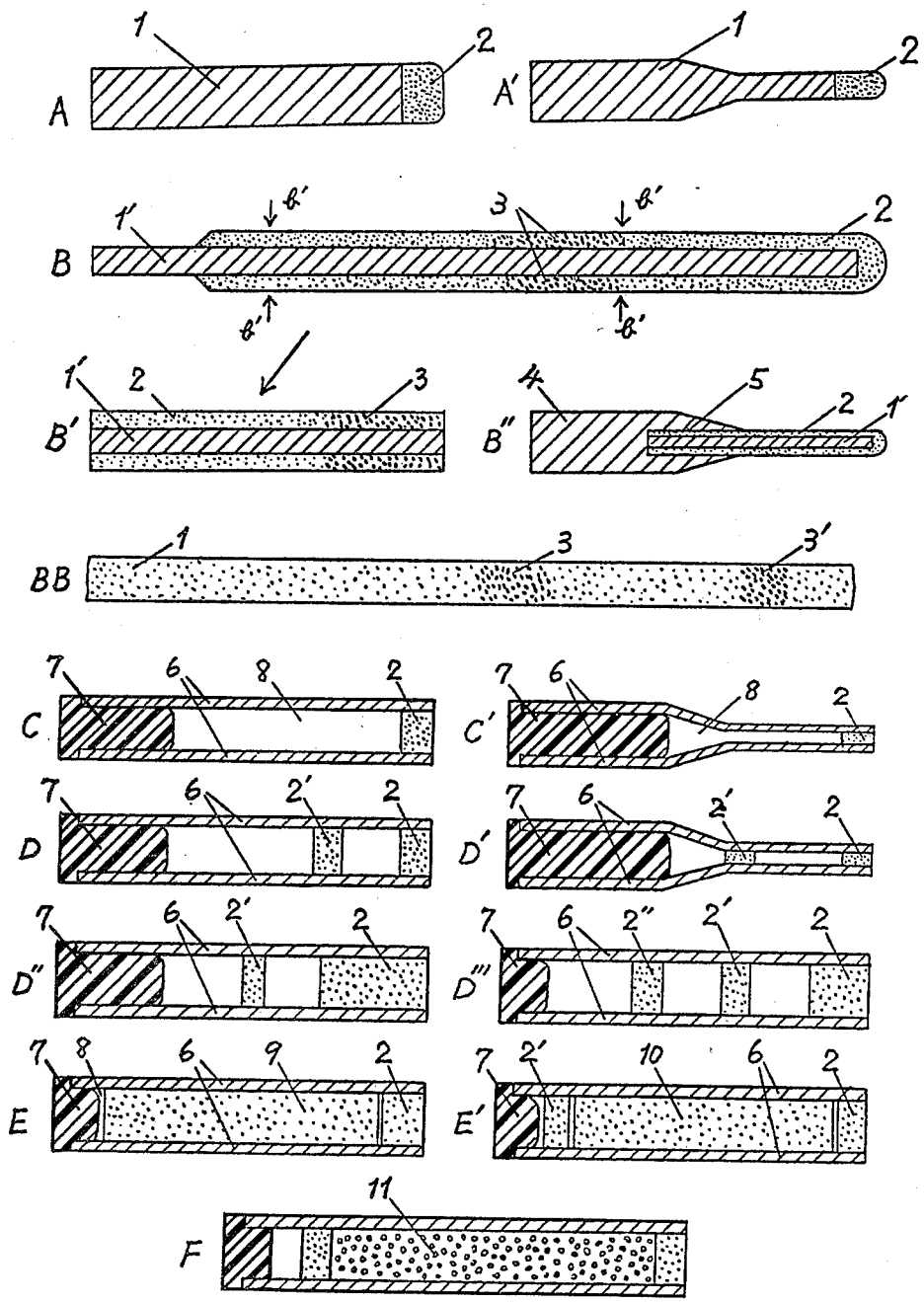

In the following paragraphs, the present invention will be illustrated in more detail with particular reference to the preferred embodiments shown in the appended drawings, wherein;

FIG. 1 shows, collectively, each of the cross-sections of the sample holding elements of the present invention, each indicated by characters A through F, and FIGS. 2 through 21 are graphical views representing the results of measurements obtained with the illustrated elements.

In FIG. 1, the most fundamental embodiment A is shown as including a porous aggregate 2 affixed at the tip of the solid supporting rod 1 by adhesion or welding. The embodiment indicated by A' is analogous to that of A but modified for the In-Beam measuring system.

An embodiment B with a solid supporting rod 1' which is covered with a layer of porous aggregate 2, is capable of developing a chromatogram by any ascending solvent as is in the case of thin layer chromatography. In such case, the intended substance in the sample may be separated and concentrated at a particular portion including a band spot 3 in accordance with its specific Rf value. If the spot is visible, the portion including the spot may be cut to make it as the aggregate of the element of the present invention as indicated by the arrow b'.

The cut portion B' may of course be placed to be held by the bracket of the direct sample introducing probe so as to project the spot 3 from the tip of the bracket and thereafter is processed in a mass spectrometer. It is needless to say that the solvent must be removed by evaporation in advance of the mass spectrometry.

If a plurality of spots appear in the chromatogram as a result of development of a mixture sample, the aggregate may be cut into a plurality of portions which are separately introduced into the ionization chamber.

Visual inspection and arbitrary trimming of the particular portions carrying the intended substance which has no absorption band in the visible region and is inherently colorless may then be made possible in the element of a similar type but which has a fluorescent material included as an ingredient of its aggregate, by the use of ultraviolet radiation.

The embodiment indicated by B'' is a modification of B wherein the diameter of the aggregate portion B' is much smaller than that of the internal diameter of the bracket and the cut aggregate is inserted into a hole 5 drilled in a stem 4 of the refractory and insulating material, for example, quartz or borosilicate glass, capable of being engaged with the bracket. This is particularly suited for the stated In-Beam system. Another embodiment BB is a modification of B, which is a self-supporting aggregate lacking a center solid rod and having the same application as that of B, being illustrated as two separate spots 3 and 3' appearing along the elongated aggregate.

An embodiment C is shown to illustrate another mode wherein an aggregate 2 is fixed at the tip of the tubular support 6 which is preferably made of the identical material as that of the aggregate. The vacant chamber 8 is suited for accomodating a solid sample, such as crystals or powder.

In actual use, the open end of the root portion must be sealed beforehand, with an elastic plug 7 made of Teflon or silicone rubber. Sealing by welding may of course be possible. Another embodiment C' is a variant of C, modified to be adopted to the In-Beam system.

The embodiment indicated by D is similarly constructed as that of C but has an additional aggregate 2' in the intermediate region of the tubular support. This arrangement of the aggregates is particularly suited for the measurement of a liquid sample which may be confined in the space between both aggregates. In actual measurement, the second aggregate 2' is impregnated with the liquid sample which is separated and ionized during the passage through the first aggregate 2 with an appropriate time interval. A further embodiment D' is likewise a variant of D which is adopted to the In-Beam measurement. A modification which either has an elongated aggregate 2 at the tip as indicated by D'' or has a third aggregate 2'' in addition to the second aggregate 2', indicated by D'' may be constructed in accordance with the intended measurement.

At present, no sufficient elucidation on an exact mechanism for separating or fractionating a mixture sample into its components has yet been made in the case wherein any of the aggregate do not contain any material having chromatographic activity but rather is constituted only with an inert ingredient such as glass and is arranged as has been illustrated.

A presumption may however be made in that a difference in the travelling speeds of the respective substances contained in the mixture through the interstices of the aggregate, may result in selective effluence and subsequent sequential vaporization of each of the substances, which serve for separation, if the molecular sizes of the component substances are in a pertinent correlation with respect to the dimensions of the interstices. It may alternatively be interpreted as a more rectification by repetitive distillation within the fine structure of the interstices, but it is more conservative and reasonable to refrain from referring to the exact mechanism. Presumably the obtained performance may be attributable to both functions. It is however confirmed that a separating operation to an extent sufficient for the practical purpose can be made and therefore the separation at the preceding step can be dispensed with to lead to an improvement in the quantitative value of determination due to the limited loss of the sample, which would be substantial if a preceding separation step were employed.

The preferred void ratio calculated on the basis of the intrinsic specific gravity of the skeletal ingredient ranges from 15% to 70% and preferably from 25% to 60%, depending on the substance to be separated.

The embodiment indicated by E holds a fourth aggregate 9 which is consituted with a chromatographically-active adsorbent as its principal ingredient, said adsorbent occupying most of the effective length (along which heat can be applied) of the space 8.

With such an element, development of an ascending chromatogram from the root portion with its root and kept open as well as a direct mass spectrometric measurement after the sample is applied to the root of the fourth aggregate 9, with its root end sealed, are likewise possible. In the former case, incorporation of a fluorescent material into the adsorbent and the use of a tubular support made of ultraviolet ray transmitting glass are essential for visual inspection of the band spot of a colorless substance in the chromatogram.

Embodiment E' is of a construction analogous to that of E but the root end of the tubular support 6 is also sealed with the second type of aggregate 2'. In this case, the adsorbent in the space 8 may not necessarily be an aggregate but a material with fluidity, for example, a powder, but stamped to form a column 10.

Another embodiment F is similar to E' but differs in the stuffing of the space with a filler for gas chromatography instead of the stamped column of adsorbent 10.

Measurements

Examples of measurements performed with typical elements illustrated in FIG. 1, will be described below.

(1) Element of Structure A (i) Aggregate: Sintered body of fine glass powder.
Glass: Borosilicate glass.
Granular size distribution: 15μ–30μ.
Sintering Temperature: 830° C.
Time: 10 min. (1st)+5.5 min. (2nd).
Void ratio: Approximately 26%.
Treatment: Silylation.
Finish: The sintered body is welded to a rod of borosilicate glass to form a sample holding element.

(ii) Samples, measured:
(a) Sulfamethoxazole and (b) testosterone. Each of the samples is applied to the sintered body as a solution in an inert and volatile solvent (in this case, acetone) which is removed by evaporation prior to mass spectrometric measurement. Similar procedures are followed in the measurement of other solid samples (Another solvent, for instance, chloroform is conveniently employed depending on the sample to be determined. Water which would never be used in the pot-type holder may also be employed in some instances).

Figure 2:
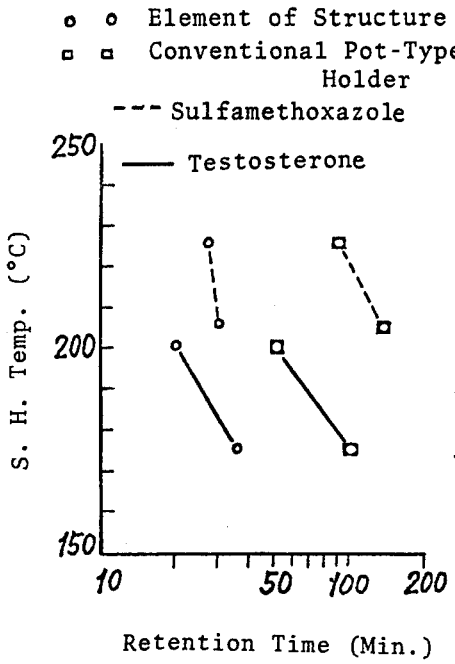

(iii) Results:
Retention time versus Sample heater (S.H.) temperature characteristics obtained with the element of Structure A as compared with those obtained with the conventional pot-type holder is shown in FIG. 2.

From the results, it is appreciated that, the rate of vaporization of the sample is effectively regulated (in this particular case, being accelerated) to facilitate the measurement by preventing or at least suppressing the possible thermal decomposition of the sample (vaporization of some specific sample may also be retarded).

Derivation of the sample into any volatile compound, for example, silylation can be dispensed with by the use of the sample holding element.

Furthermore, similar results are obtained with compressed aggregates made of mixures of particles of non-glazed porcelain, alumina, talc and the like.

Figure 3:
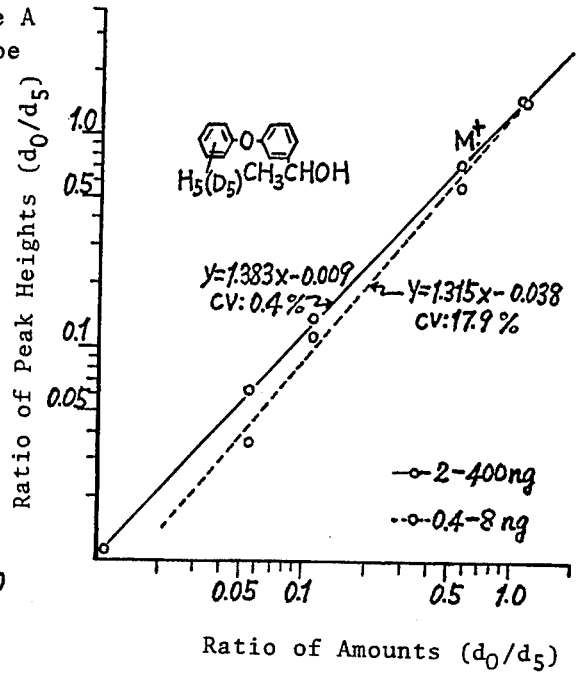

(iv) Correlation between ratios of Amount and Peak height: A measurement of 3-phenoxy-α-methylbenzylalcohol (and its derivative labeled with a stable isotope) is made to derive a calibration curve of Ratio of Amount relative to Ratio of Peak Heights as shown in FIG. 3.
(wherein: $H_5(D_5)$ indicates that the compound is labeled by substituting deuterium for its five hydrogen atoms,
$d_0/d_5$ indicates the ratio of amount of the labeled compound to that of the non-labeled compound,
M.+ is Molecular ion,
x is Independent variable; ratio of amounts,
y is Dependent variable ($y=ax+b$ represents a regression line), and
cv indicates Coefficient of variance.)

In quantitative determination by mass spectrometry, it is the usual practice to measure the sample by the use of Multiple Ion Detection (MID) equipment of a mass spectrometer, as is customary in the stated GC-MS system. The sample may be prepared with a compound labeled with a stable isotope as its internal standard substance (or inversely, a non-labeled compound may be made as the standard for the labeled compound).

The above calibration curve is derived from a selected Ion Intensity Curve (shown in FIG. 7) prepared from the results obtained by a measurement in accordance with the MID method.

(2) Element of Structure A'

(i) Aggregate: Identical with that of Structure A.
(ii) Sample, measured:

(a) Phenylthiohydantoin-arginine hydrochloride (P.T.H.-Arg-HCl) and (b) Benzyloxycarbonyl-glycyl-histidine hydrozide (Z-Gly-His-$NHNH_2$).

Figure 4:
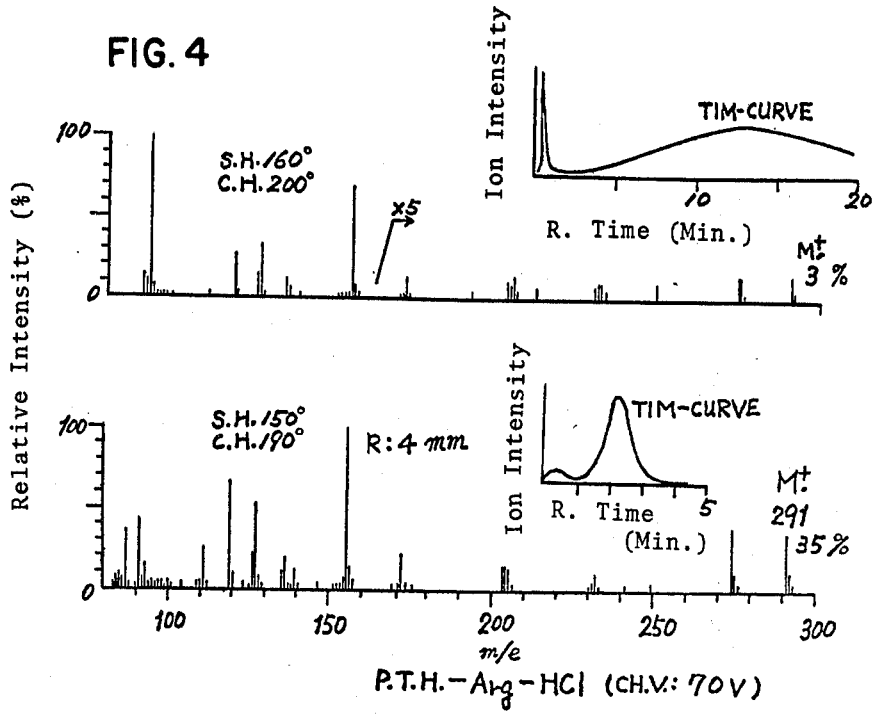
Figure 5:
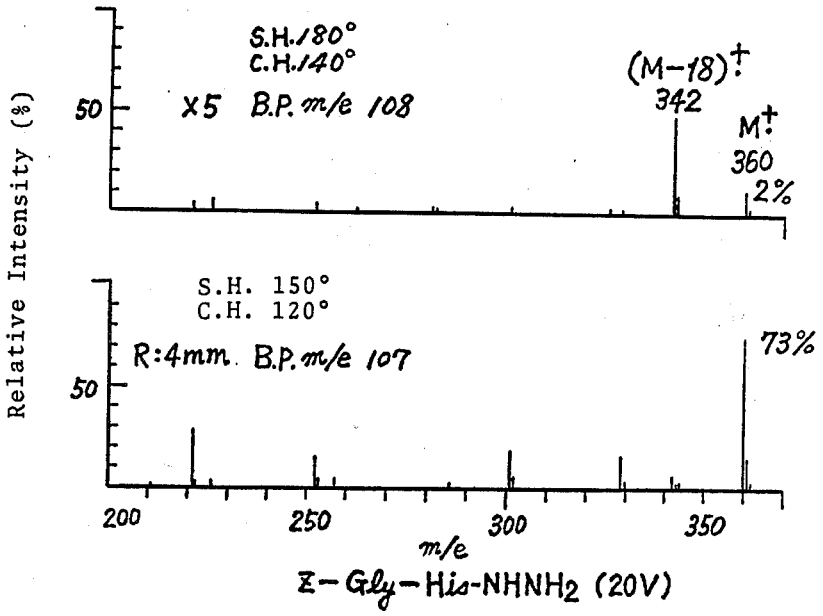

(iii) Procedure followed and Results obtained:

The above samples are measured in accordance with the In-Beam method together with comparative measurements by means of the conventional pot-type holder to depict mass spectra as shown in FIGS. 4 and 5, respectively, wherein each of the bottom spectra is obtained with the holding element of the present invention while each of the top spectra is obtained with the conventional holder and wherein the symbols CH.V., R and B.P. indicate Ionization Voltage, Distance from the center of the electron beam and Base Peak, respectively.

When each top spectrum is compared with each bottom one, it is obvious that the sensitivity in the measurement must be enhanced to five times higher in the conventional holder than in the element of this invention, for the sample (a) at its m/e (mass to charge ratio) of above 160 and for the sample (b) at its m/e of above 200.

Moreover, it is found that the method utilizing the element of this invention is suited for analyzing thermally unstable compounds, because the measurement can successfully be performed even at lower temperatures of both the Sample heater (S.H.) and Chamber heater (C.H.).

It is needless to say that the element of this invention can hold a greater amount of sample than the conventional one does.

At the spaces of both of the top and bottom spectra in FIG. 4, schematic presentations of Total Ion Monitoring (TIM) curves are also inset, wherein the TIM curve obtained by using the element of this invention indicates a sharp and intense peak.

(3) Elements of Structures B–B'

(i) Supporting rod: Quartz of diameter of 1 mm.

(ii) Aggregate: A sintered body of the composition stated below is formed as a layer (thickness, 0.5 mm) to cover the quartz rod for chromatography as indicated by B.

Adsorbent:

(a) Alumina: Aluminum Oxide Neutral, Type T.

(b) Silica gel: Kiesel gel H, Nachsthahl, Type 60 (10–40$\mu$), both available from E. Merck A.G., W. Germany.

Glass: borosilicate glass (powder of under 10$\mu$).

Fluorescent material: SPD-3D available from Toshiba Co. Ltd., Japan.

Composition by weight: Adsorbent/Glass/Fluorescent material = 1/3/0.3.

Sintering: The quartz rod is soaked so as to be covered with a slurry of the above composition in dioxane and is baked at 900°–920° C. for 7 minutes.

Void ratio: Approximately, 51%.

(iii) Sample, measured:

Mixture of the diphenylether derivatives of the formula

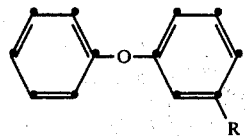

(wherein, R is —$CH(CH_3)OH$, —$COCH_3$, —$CH(CH_3)Br$ or —$CH(CH_3)CN$)

Figure 6:
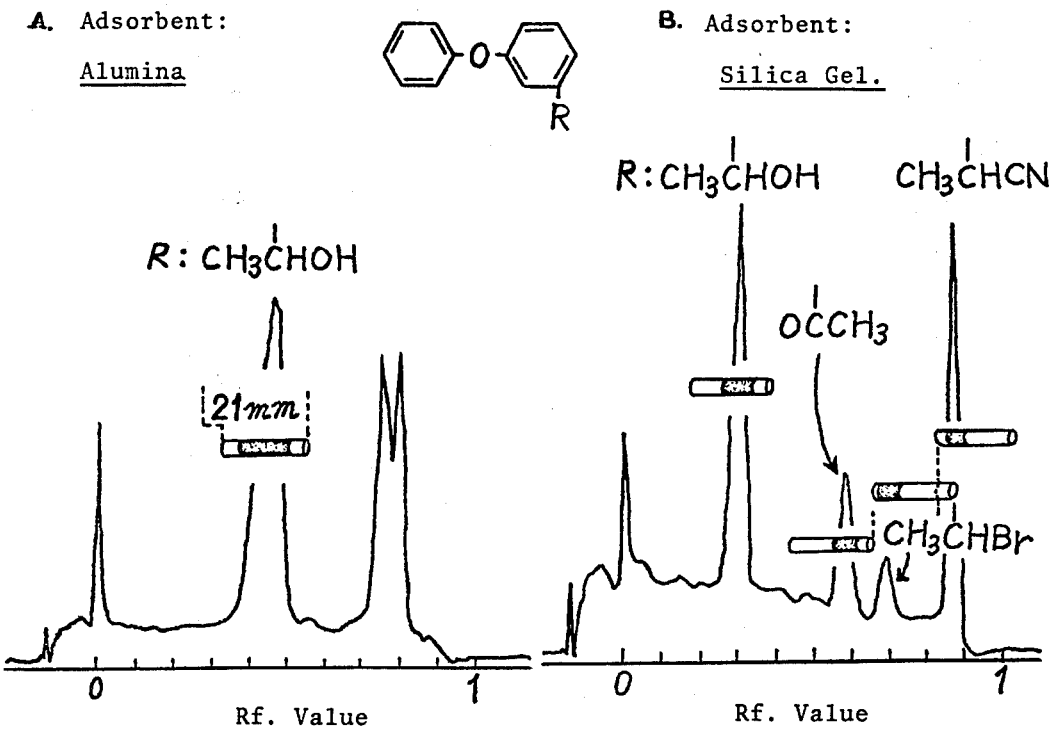

(iv) Preliminary experiment:

As ascending development of the mixture sample with a solvent (benzene:cyclohexane = 25:1) is performed on the rod carrying the aggregate (ii) which is thereafter processed in the FID (by means of Thinchrograph available from Iatoron Laboratories, Japan) to obtain the results shown in FIG. 6, wherein the schematic presentation indicates spots on the rod chromatogram while the curve indicates the FID current (arbitrary scale). The sintered rod containing silica gel is taken to the subsequent mass spectrometry, by trimming the particular portion including the spot of 3-phenoxy-$\alpha$-methylbenzylalcohol together with a margin for accommodating itself to the stem of the element of Structure B' (if the rod is thinner, a structure of B'' is preferred).

Figure 7:
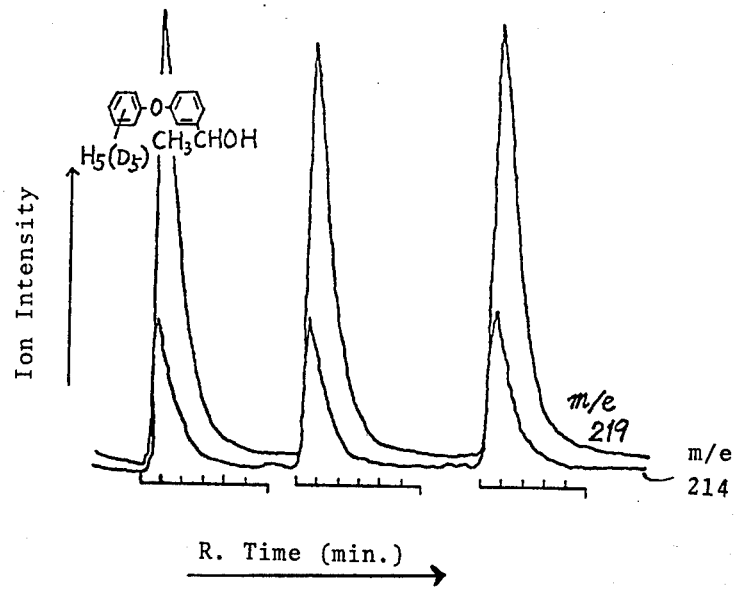

Selected Ion Intensity Curves measured in accordance with the MID method obtained with the element holding the spot obtained in the process (iv) as compared with that of labeled compound are shown in FIG. 7. The top curve (m/e, 219) represents $D_5$ compound while the bottom one (m/e, 214) represents $H_5$ compound.

Figure 8:
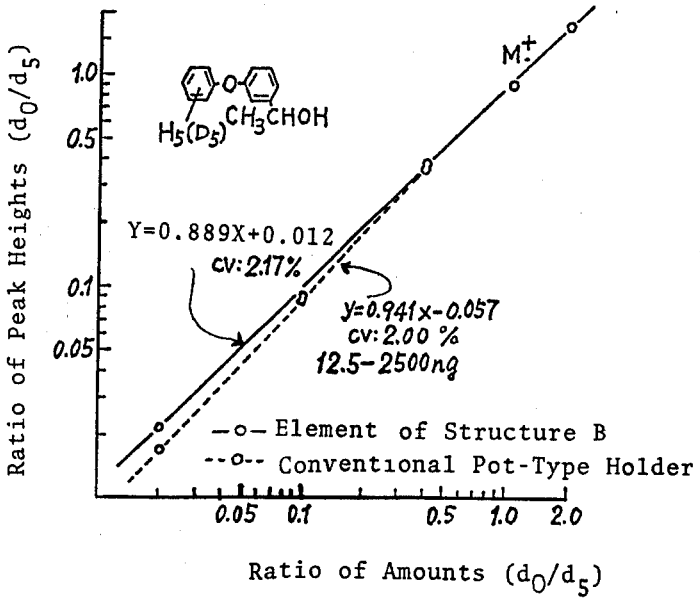
Figure 9:
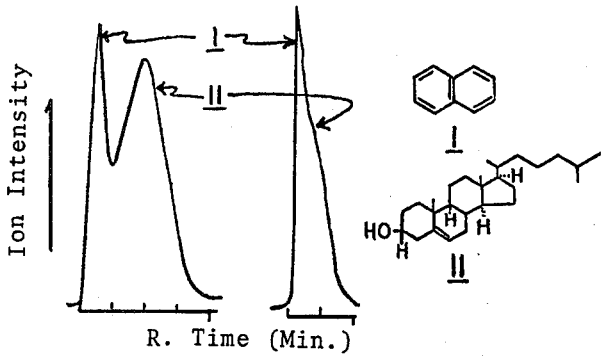

Calibration curves obtained by this method are shown in FIG. 8, wherein that obtained by the conventional method is also presented.

As described above, separation of a mixture which may contain compounds liable to be thermally decomposed in the GC process can be performed on the element of Structure B at room temperature with improved safety and accuracy. Hazards of reducing sample amount and unconditioned oxidation can be prevented by dispensing with the scraping operation inherent to thin layer chromatography for assuring a more accurate quantitative evaluation.

(4) Elements of Structures C–C'

(i) Aggregate: Identical with that of Structure A.

(ii) Tubular support: Borosilicate glass of outer diameter of 3 mm, finished as indicated by C.

Figure 10:
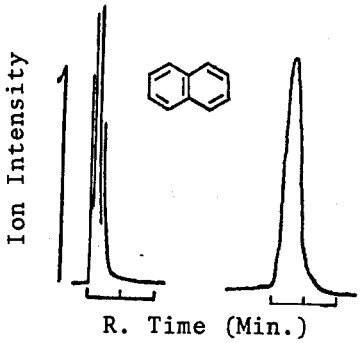

(iii) Sample measured to give their TIM charts:

(a) A mixture of napthalene (I) and cholesterol (II) (FIG. 9) and (b) Naphthalene (FIG. 10).

The measurements are made at a S.H. temperature of 170° C., and the results are depicted in contrast with those obtained with the conventional pot-type holder.

It is appreciated that a mixture which had never been separated in a mass spectrometer, can be separated (FIG. 9) and that a compound which had been very difficult to be measured due to its excessive sublimation property can also be measured with ease (FIG. 10) by means of the holding element of this invention.

Furthermore, it is found that the element of Structure C is suited for the measurement of powdery (crystalline) samples and particularly for that of the mixture which otherwise requires a precedent separating step, and is capable of ionizing a compound which is very likely to be sublimated while adequately regulating this property. The element of Structure C' modified for an In-Beam measurement gave the same result.

Figure 11:
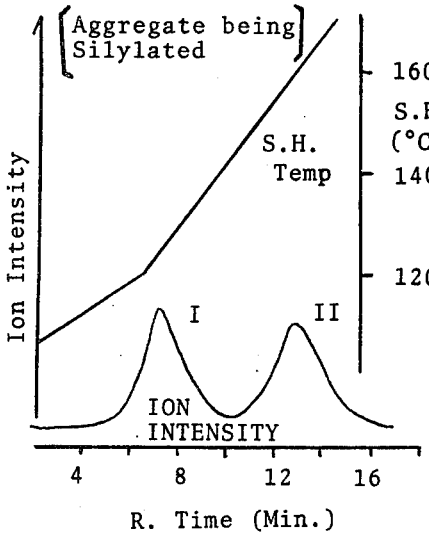
Figure 12:
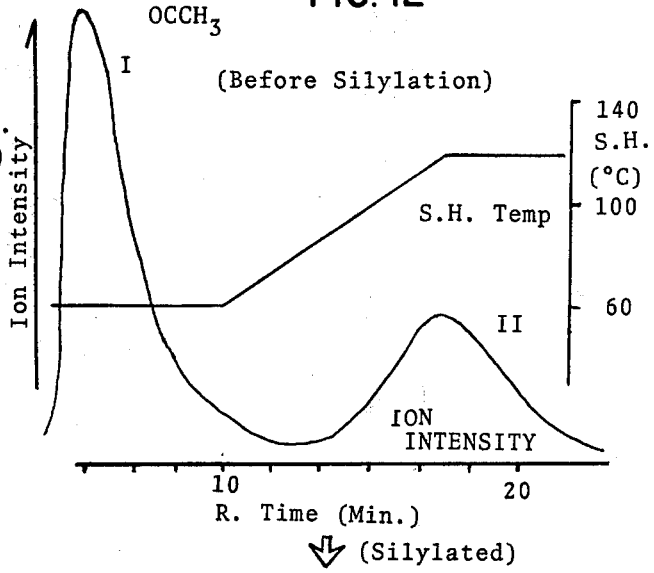
Figure 13:
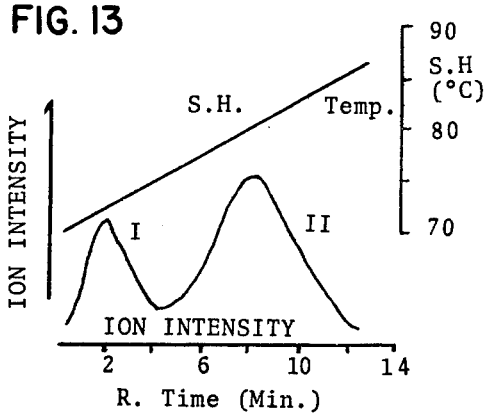
Figure 17:
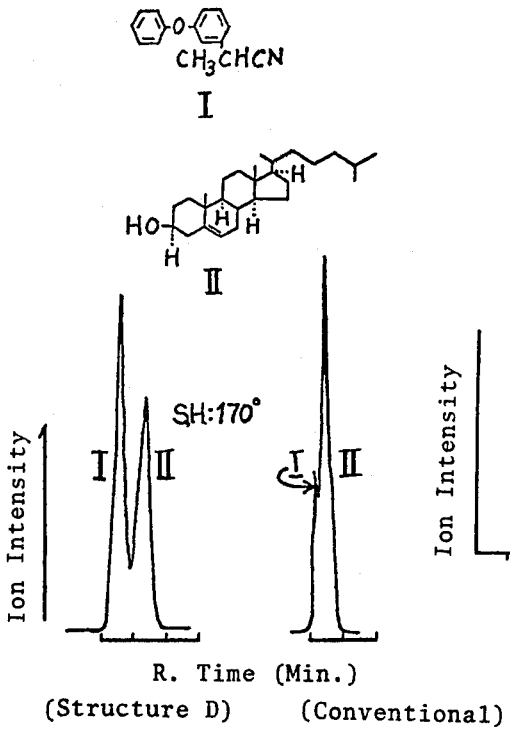

Another series of measurements is made on a mixture sample of naphthalene (I) and 3-acetyldiphenylether (II) with the elements of Structures C and C' to obtain the results shown in TIM charts of FIGS. 11, 12 and 13.

In this case, however, sintered aggregates of soda-lime glass powder (under 10μ) are formed in a cylinder (diameter, 2.0 mm, length, 25.0 mm) covered with the solid glass layer (thickness, 0.5 mm) to be shaped to an element of Structure C (FIG. 11) and that formed in a rectangular rod (1.0×1.0×20.0 mm) covered with the same solid glass layer to be finished as that of Structure C' (FIGS. 12 and 13).

Measurements before and after the silylation (Silyl 8, available from Pierce Chemical Company, U.S.A.) are also made to demonstrate the effect of the silylation for accelerating the effluence of the sample, i.e., the availability of lower S.H. temperature.

Figure 14:
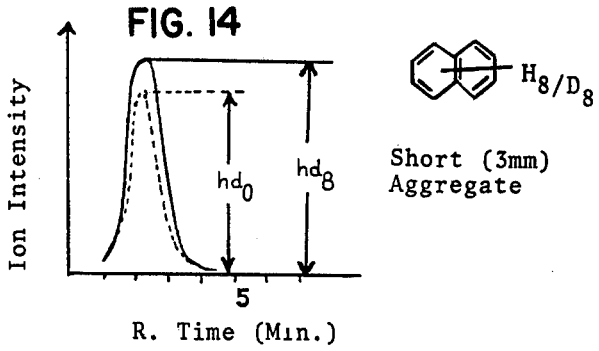
Figure 15:
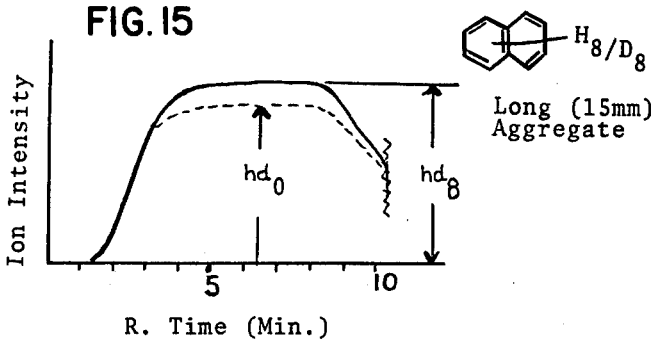

A further series of measurements is made on a labeled and nonlabeled naphthalene with two elements of Structure C, each holding aggregates of different lengthes (the same ingredient as the preceding measurements) of 3 mm and 15 mm, to obtain the results shown in FIGS. 14 and 15 wherein the solid curves represent the labeled compound while the dotted curves represent the nonlabeled compound.

The sample is in a solution of diethyl ether which is applied behind the aggregate 2.

As illustrated in these figures, both elements can be processed in the MID equipment for quantitative evaluation of the substances but the longer one can perform a quantitative determination by scanning the limited mass region instead of using the MID equipment.

Figure 16:
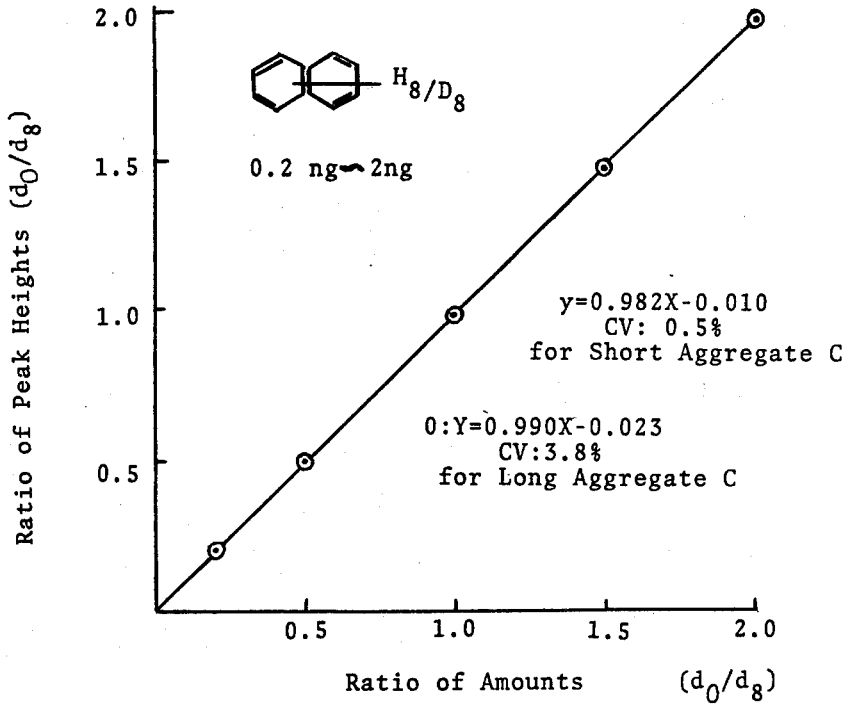

From FIGS. 14 and 15, a calibration curve of Ratio of Amount to Ratio of Peak Height is prepared as shown in FIG. 16, wherein the coefficient of variance for short aggregate is 0.5% while that for long aggregate is 3.8% but the curves themselves are virtually superimposed.

(5) Elements of Structures D–D'

(i) Aggregate: Components are identical with those used in the elements of Structures C–C' but an additional aggregate 2' is arranged in the intermediate region so that the sample can be injected behind the second aggregate with a microsyringe.

(ii) Samples, measured to give their TIM charts.

Figure 19:
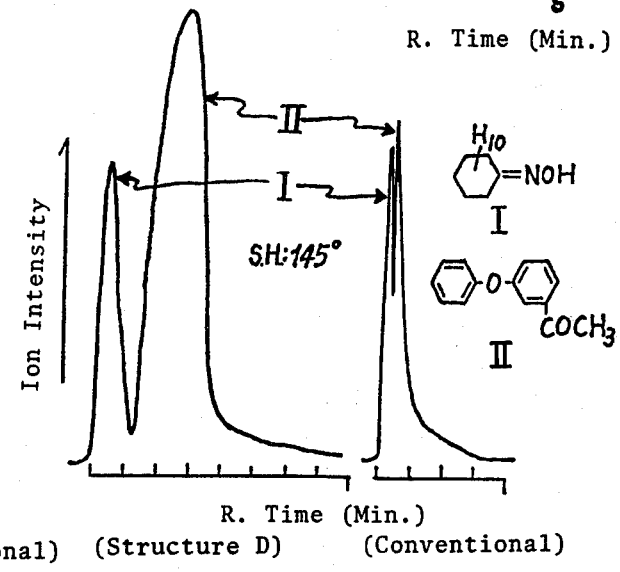

(a) Mixture of 3-phenoxyphenylpropionitrile (I) and cholesterol (II) (FIG. 17), (b) Mixture of naphthalene (I) and 3-acetyldiphenylether (II) (FIG. 18), and (c) Mixture of cyclohexanone oxime (I) and 3-acetyldiphenylether (II) (FIG. 19).

Each of these is shown in contrast with the results obtained with the conventional pot-type holder, supporting the advantages that the separating performances are much improved by utilizing the holding elements of this invention. Meanwhile, it may also be appreciated that the element of Structure D' having an elongated tip aggregate 2 and that of Structure D" having an additional aggregate 2" is suited for making the separation more distinctive.

Figure 20:
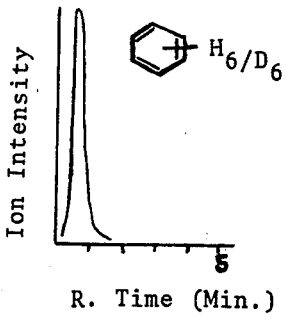
Figure 18:
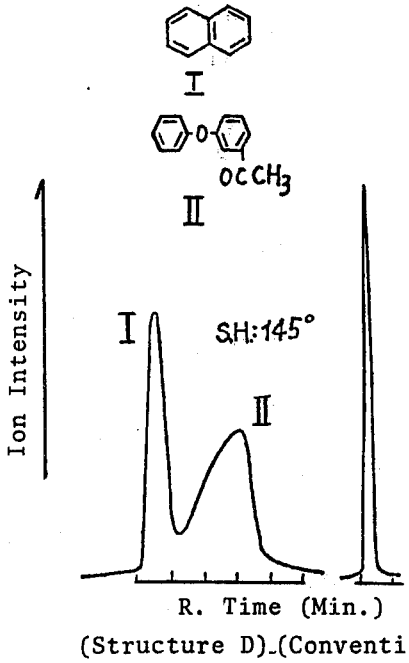
Figure 21:
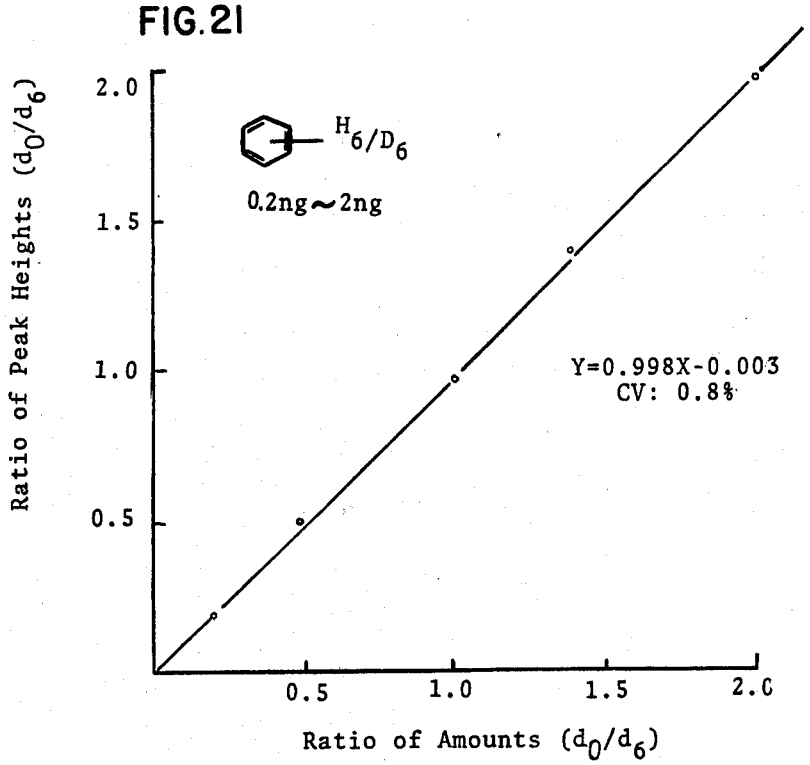

Another measurement is made on a labeled and nonlabeled benzene with the element of Structure D" holding the tip aggregate 2' as well as the spaced-apart (3.0 mm) additional aggregate 2 (sintered body of soda-lime glass powder having a diameter of 2.0 mm, and lengths of 2.0 mm and 1.5 mm), to give the results shown in the TIM chart of FIG. 20 and the calibration curve of FIG. 21.

Although not exemplified with particular reference to the actual results of measurements, it is obvious that the elements of Structures E–E' can be used for the chromatographic development with a solvent as is possible with the element of Structure B, to enable sequential vaporization and ionization of respective components for mass spectrometry. The holding element of Structure F is suited for an operation analogous to gas chromatography but without any carrier gas, within the structural unit of the conventional mass spectrometer.

In the exemplified measurements utilizing the element of this invention, 3-phenoxy-α-methylbenzylalcohol is quantitatively determined at a relative error of 0.2–0.3% while the same substance can be determined by Nuclear Magnetic Resonance (NMR) system at a relative error as large as ±5% and by Infrared Spectrometry (IR) at a relative error as large as ±3%. With the use of the holding element of this invention, mass spectrometry of mixture samples can also be performed at a relative error of the same level, i.e., 0.2–0.3%, not to mention the determination of a single substance.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A sample holding element for use in mass spectrometry which comprises a porous and gas-permeable aggregate of at least one skeletal ingredient of finely divided inorganic substance having refractory and electrical-insulating properties selected from the group consisting of glass, ceramic material and chromatographically-active adsorbent with a void ratio ranging from 15% to 70%.

2. A sample holding element as claimed in claim 1, wherein the void ratio is from 25% to 60%.

3. A sample holding element as claimed in claims 1 or 2 wherein the skeletal ingredient is glass.

4. A sample holding element as claimed in claims 1 or 2 wherein the skeletal ingredient is a ceramic material.

5. A sample holding element as claimed in claims 1 or 2 wherein the skeletal ingredient is chromatographically-active adsorbent.

6. A sample holding element as claimed in claims 1 or 2, wherein the finely divided inorganic substance is in the form of fine particles or thin strings, and is sintered to form the aggregate having numerous fine interstices therein.

7. A sample holding element as claimed in claims 1 or 2, wherein the aggregate is a compressed body of fine particles of the skeletal ingredient having numerous fine interstices therein.

8. A sample holding element as claimed in claims 1 or 2, wherein the surfaces of the skeletal ingredient are at least partly silylated.

9. A sample holding element as claimed in claim 5, wherein the particles of chromatographically-active adsorbent are embraced within the interstices of said aggregate.

10. A sample holding element as claimed in claim 9, wherein particles of fluorescent material are also embraced within the interstices of said aggregate.

11. A sample holding element as claimed in claims 1 or 2, wherein the aggregate is disposed at the tip of a solid supporting rod.

12. A sample holding element as claimed in claims 1 or 2, wherein the aggregate is formed so as to encompass at least part of a solid supporting rod.

13. A sample holding element as claimed in claim 12, wherein the sectional diameter of the tip portion of the solid support is smaller than that of the root portion engageable with a bracket of a sample introducing probe of a mass spectrometer.

14. A sample holding element as claimed in claim 12, wherein the porous aggregate is shaped as a plug for sealing one open end of a solid tubular support having a root portion of a sealable open end.

15. A sample holding element as claimed in claim 14, wherein at least one additional aggregate incorporating a chromatographically-active adsorbent is disposed adjacent to the aggregate which seals the open end.

16. A sample holding element as claimed in claim 14, wherein at least one additional aggregate is spaced-apart from the aggregate disposed at the tip, within the tubular support.

17. A sample holding element as claimed in claim 16, wherein at least one chromatographically-active adsorbent is filled within the space formed between the tip aggregate and the additional aggregate.

18. A sample holding element as claimed in claim 14, wherein the sectional diameter of the tip portion of the tubular support is smaller than that of the root portion.

19. A method for quantitative determination by means of mass spectrometry, which comprises employing a sample holding element as defined in claim 1 in the mass spectrometer wherein a sample mixture is separated into its components in advance of ionization.

20. A method as claimed in claim 19, wherein the separation of the sample mixture is effected by developing a chromatogram over the aggregate to at least one band spot which is thereafter mass spectrometrically measured.

21. A method as claimed in claim 19, wherein the separation of the mixture is effected within the aggregate without any carrier gas and the components are ionized and determined in timed sequence.

* * * * *